United States Patent [19]

Stöffler et al.

[11] Patent Number: 4,913,322

[45] Date of Patent: Apr. 3, 1990

[54] DISPENSER FOR PASTY COMPOSITIONS

[75] Inventors: Albert Stöffler, Düsseldorf; Josef Hilgefort, Neuenkirchen, both of Fed. Rep. of Germany

[73] Assignee: Bramlage Gesellschaft mit beschränkter Haftung, Fed. Rep. of Germany

[21] Appl. No.: 271,047

[22] Filed: Nov. 14, 1988

[30] Foreign Application Priority Data

Nov. 13, 1987 [DE] Fed. Rep. of Germany ..... 3738548

[51] Int. Cl.[4] ..... B65D 37/00

[52] U.S. Cl. ..... 222/207; 222/213; 222/494

[58] Field of Search ..... 222/207, 213, 389, 386, 222/387, 385, 494, 491, 383

[56] References Cited

U.S. PATENT DOCUMENTS

| | | | |
|---|---|---|---|
| 3,087,656 | 4/1963 | Dougherty | 222/213 |
| 3,754,690 | 8/1973 | Marchant | 222/494 |
| 4,230,240 | 10/1980 | Laauwe | 222/494 |
| 4,771,925 | 9/1988 | Stoffler et al. | 222/207 |

FOREIGN PATENT DOCUMENTS 2581370 6/1985 France .

*Primary Examiner*—H. Grant Skaggs
*Assistant Examiner*—Kenneth Noland
*Attorney, Agent, or Firm*—Martin A. Farber

[57] ABSTRACT

A dispenser for pasty compositions, having a housing with a piston which is displaceable only in the emptying direction and an actuating handle on the outside by which action can be effected on a pump element which can be depressed in the direction of the piston. The pump element has an inlet valve and an outlet valve, the outlet valve being arranged in the actuating handle, the outlet valve being furthermore spring-urged into its closed position by means of spring elements which are developed thereon and extend into the inside of the dispenser. This provides for an embodiment which is simple to manufacture and advantageous in use. The spring elements are developed as spring legs which are formed free standing directly on a valve plate and rest against a collar of the actuating handle.

17 Claims, 2 Drawing Sheets

DISPENSER FOR PASTY COMPOSITIONS

FIELD AND BACKGROUND OF THE INVENTION

The present invention relates to a dispenser for pasty compositions, having a housing which has a piston which is displaceable only in the direction of emptying and an actuating handle located on the outside by which action can be effected on a pump element which can be depressed in the direction of the piston, the pump element having an inlet valve and an outlet valve and the outlet valve being arranged in the actuating handle, the outlet valve being furthermore spring-urged into its closed position by means of spring elements developed thereon which extend into the inside of the dispenser.

In one dispenser which is available on the market, the outlet valve is seated in an inward directed extension of the actuating handle. The outlet opening of the corresponding pump element, which opening lies above the outlet valve, is closed by a special plug. The latter is developed on a hinged cover which is supported on its edge. In addition to the inlet and outlet valves a piston which is mounted in a cylinder forming a pump chamber also forms part of the pump element. Said plug closure, as a rule, leads to a displacement of the pasty composition remaining in the outlet opening which then spreads out between the top of the handle and the bottom of the closure cover. This generally is objectionable for aesthetic reasons. If, on the other hand, closing is forgotten there is then the danger of the thickening or drying out of the composition remaining on the outlet side.

SUMMARY OF THE INVENTION

The object of the present invention is to provide a dispenser of this type in a manner which is simple to manufacture and advantageous to use and in which the outlet opening is, so-to-speak, automatically closed again after each actuation.

According to the invention the spring elements are developed as spring legs (21) which are developed directly free-standing on the valve plate (20) and rest against a collar (22) of the actuating handle (B).

As a result of this development, a dispenser of this type which is of increased value in use is obtained; a special plug including the corresponding support can be dispensed with. The closing of the outlet opening is effected by the outlet valve itself. The structural means are simple and surprisingly favorable for assembling. Specifically, the spring elements are developed as spring legs formed in protruding manner directly on the valve plate and resting on a collar of the actuating handle. In this way the actuating handle can be installed pre-assembled and the dispenser is then incorporated in extremely simple fashion.

The spring legs rest against the actuating handle itself. Their position is precisely defined and cannot be impaired, despite extension into the pump element. In this connection it is, as a whole, advantageous for the installation of the outlet valve that its valve plate be seated in a cone which opens toward the outside and is fitted in the valve opening. For the insertion of the valve plate, it is merely necessary to bring the spring legs together and pass them through the valve opening. In order to arrive at a satisfactory reserve for lengthening of the spring legs, the spring legs are developed so that they first extend parallel to the central axis of the dispenser and then rest with a bend against the collar.

Both for protected insertion of the relatively sensitive ring body and for as compact as possible a form of the pump element it has proven advantageous for the springout length of the spring legs to be arranged within the collar. The collar is thus imparted a further function; it not only serves as flow bridge for the medium to be dispensed but at the same time forms a spring chamber. In addition, it has been found favorable for the spring legs to engage in hook-like manner over a front region of the collar. This leads to a particularly secure positioning of the spring/ valve body. It is furthermore proposed that the actuating handle be developed substantially concave in order to form a spreading surface. For more fluid substances there is even a sort of collecting shell the periphery of which is located at a higher level on all sides remaining as a non-wetted actuating region.

For spreading without residue of the pasty composition or the like released, it is useful for the valve plate to be fitted on the outside in the closed position in the actuating handle in the same plane. The user in this way does not encounter any disturbing projections. The spreading surface is kept cleaner. It is furthermore proposed that the collar of the actuating handle be a guide collar, guided in a bellows of the pump element which has an outer collar. What is meant is not a displacement guide but a place-on guide and therefore a plug association. The bellows, which are rooted peripherally on the outer collar, is in this way attached in proper association.

Furthermore, the invention proposes that the collar of the actuating handle terminate at a distance from the lower edge of the outer collar and that the spring legs find a resting surface on the resultant step. In this way, even the anchoring zones of the spring legs are installed in protected fashion. Furthermore, there results a defined peripheral support for these ends. It is furthermore advantageous from a structural standpoint for the bellows to be developed substantially dome-shaped and cooperate, via sealing regions, with a cover of the housing which bears the inlet valve.

With respect to the cover, it may be an additional structural part or else be formed on directly, in which case, naturally, the end side of the housing facing away from the actuating handle would have to be kept open for the introduction of the piston, this also for reasons of filling. The dome-shaped design contributes to the compact construction. It is favorable from a sealing standpoint for at least one of the sealing regions to surround the bellows radially on the outside.

Finally, the invention also proposes that the inlet valve correspond in its diameter substantially to the diameter of the outer collar and is arranged aligned with the outer collar and that the distance between the bottom and the inlet valve correspond to about one-third to one-half of the diameter of the inlet valve. The corresponding measure leads to a controlled delivery. With extreme axial stroke the outer collar travels in closing fashion against the delivery valve.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
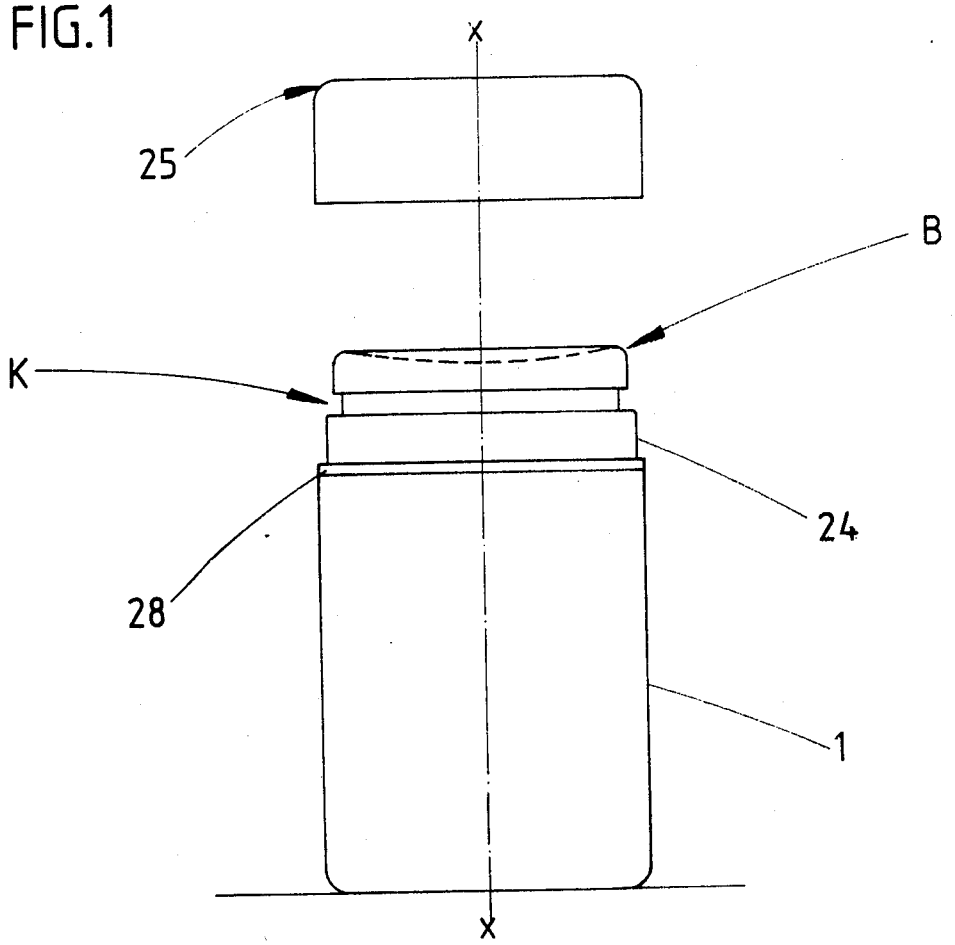
FIG. 1 shows the dispenser of the invention in a side view, with the protective cap removed but shown.
Figure 2:
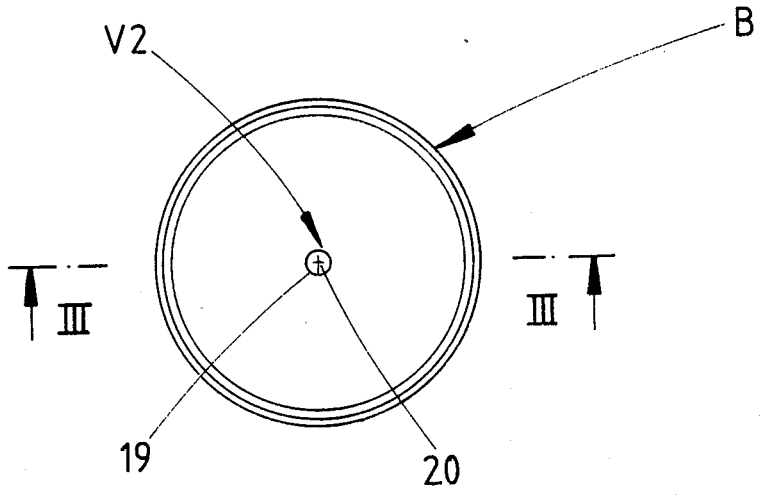
FIG. 2 is top view of FIG. 1.

The cylindrical housing 1 of the dispenser contains a piston 2. The piston is cup-shaped. The open-side half of the gun forms on the wall side an upward directed scraper lip 2' and, in the vicinity of the edge of the cup, a guide rib 2". The scraper lip 2' and guide rib 2" are guided on the cylindrical housing inner wall 1'.

The housing 1 is developed as a cup or pot which is open towards the top. Its cup bottom 3 is formed by a peripheral standing base 3'. The cup bottom 3 has in the center an opening 4 for all equalization upon the displacement of the piston which takes place in the phase of use exclusively upward, i.e., in the direction toward the arrow x. Naturally the opening 4 has the corresponding purpose also on the lowering of the sealing piston 2 into the cup-shaped housing 1.

On the end opposite the bottom 3 of the cup there is located the head K containing the delivery mechanism of the dispenser. A pump element consisting of a flexible bellows 5 which extends in dome-like fashion over a pump chamber 6 and is fastened in a cover 7 of the dome forms a part of the delivery mechanism.

The cover 7, in the present embodiment, is part of an insert 8.

An inlet valve V1 and an outlet valve V2 are furthermore a part of the pump element. The inlet valve V1 is seated in the central region 7'0 of the cover 7. This central region is arranged slightly lowered, with respect to the rest of the peripheral annular section of the cover 7, in the direction of the supply chamber 9 which is formed by the housing 1 and contains the pasty composition M. From this there results a well-defined insertion trough for the cylindrical wall region 10 of the bellows 5, which is tapered on the front side. Beyond the lowered region, the transition place between the central region 7' and the remaining peripheral region forms an annular groove 11. Inserted into this, the wall region 10 produces a practically double-sided seal, i.e., on the outside and on the inside. The outer sealing region continues up to the height of the curvature zone of the bellows 5. It is an annular wall 12. The latter extends from the top of the cover 7 and passes into an inwardly directed projection 13. This projection is gripped under by an oppositely projecting annular rib 14 of the bellows 5. The annular rib 14 is of triangular cross section. The one side of the cross section is rooted in the wall surface of the wall region 10, which wall region extends in the same direction upward over the curvature attachment region of the dome there. The corresponding accumulation of material leads to an essential stabilization of the anchoring. The flank of the annular rib 14 which lies in the direction of insertion of the bellows is somewhat flatter than the rear flank, so that the engagement of the bellows 5 on the cover 7 is facilitated while, on the other hand, a practically undetachable positioning is obtained in connected condition.

The inlet valve V1 which is developed as nonreturn valve is a valve flap 15 which is attached by a lateral film hinge 16 to the cover 7 over the central region 7'. The valve-seat surface is present on the top of said central section 7'.

The bellows 5 which can be compressed in the direction of the piston 2 is in communication with an actuating handle P on the outside. This handle is a plate-shaped base body with downward-directed edge 16 which continues via a transverse rounding 17 of rotational symmetry into the similarly concave trough. This trough region forms a spreading surface 18 for the pasty composition M which can be discharged in dosed portions in the center. The center forms for this an outlet opening which, in the basic position of the dispenser, is held closed by the valve plate 20 of the outlet valve V2.

The outlet opening 19 which receives the valve plate 20 is developed as an outwardly opening hollow cone, and the valve plate 20 therefore fits into the outlet opening 19 or valve opening. The valve plate 20 completely fills the opening. It extends slightly over the bottom of the actuating handle B, which is formed by a relatively thin wall. On the outside or top there remains, on the other hand, an alignment on the same plane to the spreading surface 18. The pasty composition emerging via the annular slot between valve plate 20 and the valve opening 19 forming the valve seat surface can thus be removed as from a smooth plate.

The valve plate 20 of the outlet valve V2 is held by spring elements in its proper basic closing position. The spring elements are spring legs 21. The latter are rooted on the bottom of the valve plate 20. They are formed directly protruding on the latter, in the vicinity of the edge. At least two spring legs 21 lying diametrically opposite each other with slight initial tension produce the closed valve position. The spring legs find their support on a collar 22. This collar 22 is rooted on the bottom of the actuating handle B. It is therefore developed as cylindrical annular wall extending concentrically to the valve-seat-forming outlet opening 19 or longitudinal central axis x—x of the dispenser.

The axial resting surface is formed by the free front end 22' of the collar 22 on which is supported the free end 21' of the spring legs 21 which are bent outward perpendicular to the longitudinal central plane x—x. A sort of undercut engagement can also be effected. The spring legs 21 are then continued into a beveling which converges upward towards the center into the section which extends parallel to the longitudinal center axis x—x. The corresponding bend results in the reserve for spring lengthening. Since the corresponding springing length of the spring legs is arranged within the collar 22, the collar, in addition to serving as guide bridge for the pasty composition M, also has the function of a spring chamber. For the attachment of the outlet valve V2 shaped in this manner it is merely necessary to bundle the spring legs 21 together so that they can be passed through the narrowed inlet opening 19, with insertion into the cavity of enlarged cross section of the collar 22, the spring legs 21 then finally gripping in hook-like manner over the front region or front end 22' of the collar 22. For the final engagement, the legs can be briefly brought to a stretched position which spread position is obtained by simply introducing a spreading core from the bottom.

In order the connect to actuating handle B to the bellows 5, the latter has an outer collar 23 which grips, with friction lock in tightly sealing manner over the collar 22 which acts practically as a guide collar. Two-thirds of the length of the outer collar 23 extends into the inside of the pump chamber 6 while about one-third of its length extends above the dome-shape of its wall in the direction of the actuating handle B, against the bottom of which it rests.

The inverse end of the outer collar 23 extends slightly beyond the corresponding end of the collar 22; in other words, the collar 22 of the actuating handle B terminates at an axial distance from the lower edge of the outer collar 23. In this way there is produced with rotational symmetry a stepped corner in which the hook-shaped ends 21' of the spring legs 21 rest supported. In this way, there is also obtained a radially outward directed supporting of the spring legs. Projections which extend somewhat over the outer surface of the collar are pushed back in precise position-defined manner upon insertion of the collar 22 into the hollow of the outer collar. For all the legs there are thus present equally justified spring properties. Any tilting of the valve plate 20 and improper closure as a result thereof are avoided.

Inlet valve V1 is adapted in its diameter essentially to the diameter of the outer collar 23. The outer collar is aligned practically with the contour of the corresponding valve flap 15. The distance from the bottom of the collar to the valve flap 15 corresponds approximately to one-third to one-half of the diameter of the inlet valve V1. Thus there is a compact construction.

For the actuation, a force can be exerted in the direction of the arrow P on any edge zone of the plate-shaped actuating handle B. Extreme lateral displacements are prevented by the forming thereon of a vertical collar 24. The latter extends from the top of the cover 7, spaced from the edge. It extends concentrically to the longitudinal center axis x—x and is gripped over in partially overlapping manner in the basic position by the downward-drawn, also cylindrical edge 16 of the actuating handle B. Between the inner wall of this edge 16 and the outer wall of the vertical collar 24 there is an annular slot so that tilting movements of the actuating handle do not lead to jamming. The annular section of the cover 7 of the insert 8 which remains on the other side of the vertical collar 24 formed the limiting stop for the actuation.

Figure 3:
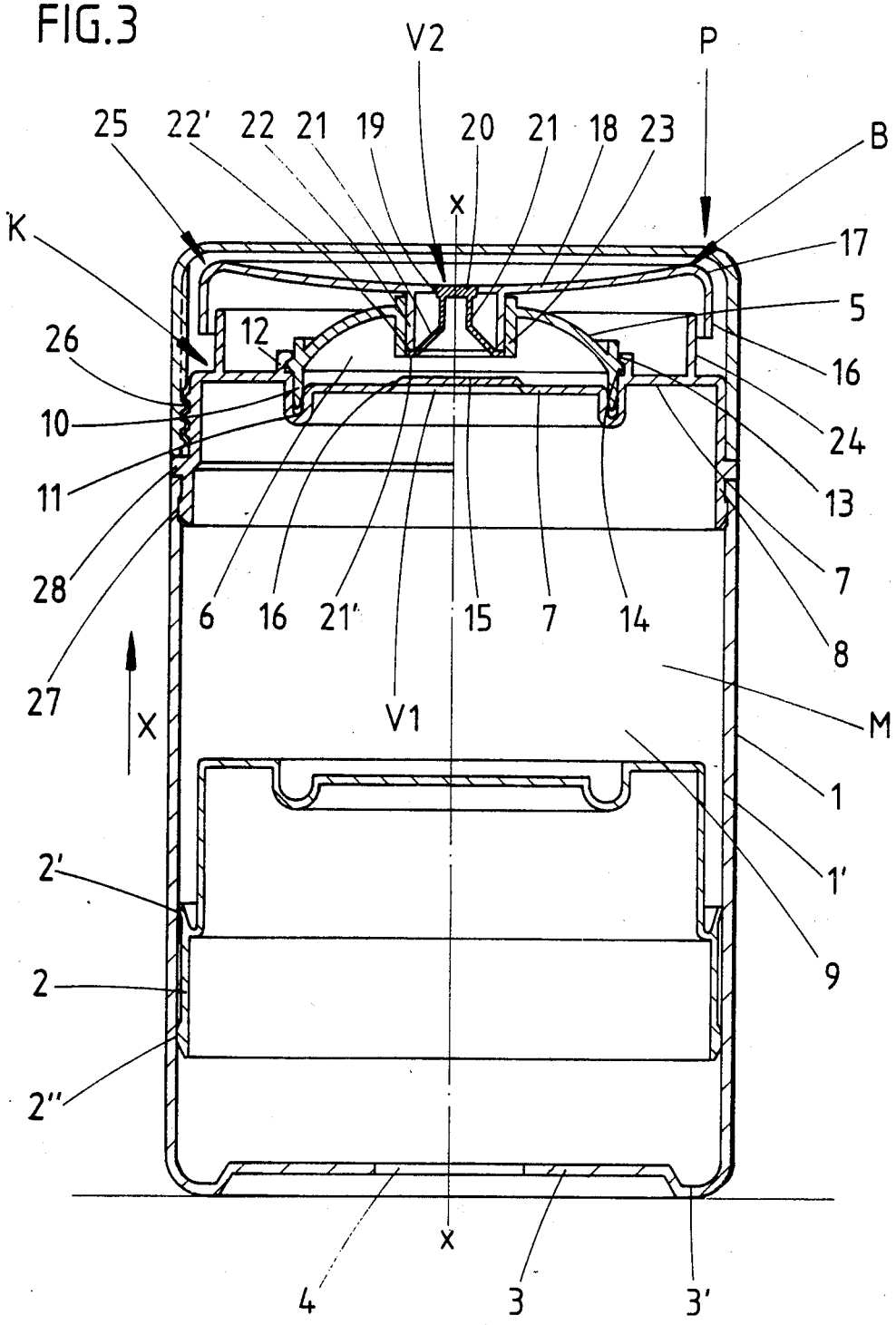
FIG. 3 is a section along the line III—III of FIG. 2, with the dispenser mechanism in its basic position and the protective cap attached.

The actuating handle B is gripped over by a protective cap 25 which is simply placed over the lid-shaped insert 8 or, as shown by the half of the section of FIG. 3 on the left, associated with it by a threaded connection. The thread engagement bears the reference number 26.

In order to secure the insert on the housing 1, a detent connection 27 between the two parts is selected. The insertion-limiting stop is assumed by an annular collar 28 developed on the outside of the outer wall of the cup-shaped insert 8, the bottom-side flank of which comes against the corresponding front end of the housing 1 while its top-side flank forms the attachment-limiting stop for the protective cap 25.

In the variant with thread development 26, the section of the cup wall lying there above the angular collar 28 is shifted inward so that a continuous alignment in the same plane of all the dispenser-forming parts is assured.

The front side of the cup-shaped piston 2 which faces the pump element has a negative contouring which corresponds to the corresponding dispenser head so that practically residue-free delivery of the paste composition M is obtained.

The operation of the dispenser is as follows:

By depressing the actuating handle in the direction indicated by the arrow P, the bellows 5 is compressed, with reduction of volume of the pump chamber 6. The portion of pasty composition present in the pump chamber passes, via the opening of the outlet valve V2, out of the outlet opening 19 and deposits on the edge zone of this opening in the center of the trough-shaped spreading surface 18. The collar 22 connected with the pump chamber 6 acts here as conduction bridge. Upon said actuation, the inlet valve V1, which is developed as nonreturn valve, remains closed as a result of the excess pressure in the pump chamber 6. As soon as the pressure decreases, the spring legs 21 pull the valve plate 20 back into its basic closed position, which completely fills the outlet opening 19. With release of the actuating handle P, the bellows 5 moves back again into its starting position as a result of the selection of suitable material. This leads to a vacuum in the pump chamber 6. Accordingly, the valve flap 16 lifts, swinging around its lateral film hinge 16. Via the corresponding valve opening, pasty composition is now drawn into the pump chamber 6. Along with this, the piston 2 moves one step in the direction of the head piece k over the filling-level column. The drawing-in of secondary air is prevented as a result of the function of the outlet valve V2, as is any drying out of the pasty composition.

We claim:

1. A dispenser for pasty compositions comprising a housing with a piston therein, the housing and the piston defining a space for holding a pasty composition, the piston being displaceable only in a direction of emptying the housing of the pasty composition;

a pump element secured to the housing, said holding space lying between said piston and said pump element;

an actuating handle having a collar and lying on the outside of said housing, the handle being operatively connected to said pump element for actuating the pump element to be depressed in the direction of the piston; and wherein said pump element comprises an inlet valve and an outlet valve, the outlet valve being disposed in the actuating handle, the outlet valve comprising spring elements developed thereon and which extend into the inside of the dispenser, and a valve plate, the spring elements urging the outlet valve into its closed position; and wherein said spring elements are formed as spring legs which are developed directly free-standing on the valve plate and rest against the collar of the actuating handle; and during a depression of the actuating handle, the collar constrains the spring legs to undergo the same flexing independently of any tilting of the actuating handle.

2. A dispenser according to claim 1, wherein the outlet valve has outward tapering cone, and the valve plate is seated over the cone and is fitted into an opening of the valve.

3. A dispenser according to claim 1, wherein the spring legs are developed as initially extending parallel to a central axis of the dispenser, the legs bending towards and resting against the collar.

4. A dispenser according to claim 1, wherein a springing length of the spring legs is arranged within the collar.

5. A dispenser according to claim 1, wherein
the spring legs engage in hook-like manner over a front region of the collar.
6. A dispenser according to claim 1, wherein
7. A dispenser according to claim 1, wherein
the collar extends inwardly toward the holding space.
8. A dispenser according to claim 1, wherein
the spring legs press against an inner edge of the collar to urge the valve plate inwardly toward the holding space for closing the outlet valve, the inner edge of the collar facing said holding space.
9. A dispenser according to claim 8, wherein
the spring legs extend through the collar.
10. a dispenser according to claim 1, wherein
the valve plate is movable in a direction away from said holding space to form a valve opening between said plate and said handle.
11. A dispenser for pasty compositions comprising
a housing with a piston therein, the housing and the piston defining a space for holding a pasty composition, the piston being displaceable only in a direction of emptying the housing of the pasty composition;
a pump element secured to the housing, said holding space lying between said piston and said pump element;
an actuating handle having a collar and lying on the outside of said housing, the handle being operatively connected to said pump element for actuating the pump element to be depressed in the direction of the piston; and wherein
said pump element comprises
an inlet valve and an outlet valve, the outlet valve being disposed in the actuating handle, the outlet valve comprising spring elements developed thereon and which extend into the inside of the dispenser, and a valve plate, the spring elements urging the outlet valve into its closed position; and wherein
said spring elements are formed as spring legs which are developed directly free-standing on the valve plate and rest against the collar of the actuating handle; and
the actuating handle has a substantially concave spreading surface.
12. A dispenser for pasty compositions comprising
a housing with a piston therein, the housing and the piston defining a space for holding a pasty composition, the piston being displaceable only in a direction of emptying the housing of the pasty composition;
a pump element secured to the housing, said holding space lying between said piston and said pump element;
an actuating handle having a collar and lying on the outside of said housing, the handle being operatively connected to said pump element for actuating the pump element to be depressed in the direction of the piston; and wherein
said pump element comprises
an inlet valve and an outlet valve, the outlet valve being disposed in the actuating handle, the outlet valve comprising spring elements developed thereon and which extend into the inside of the dispenser, and a valve plate, the spring elements urging the outlet valve into its closed position; and wherein
said spring elements are formed as spring legs which are developed directly free-standing on the valve plate and rest against the collar of the actuating handle;
the pump element has a bellows; and
the collar of the actuating handle is a plug-guide, guided in the bellows of the pump element, which bellows has an outer collar encircling the handle collar.
the valve plate in closed position is fitted in a common plane with the actuating handle.
13. A dispenser according to claim 12, wherein
the handle collar terminates at a distance from a lower edge of the outer collar, and that the spring legs extend to a resting surface in the resulting corner step.
14. A dispenser according to claim 12, wherein
the housing has cover and an inlet valve supported by the cover; and
the bellows is essentially dome-shaped and cooperates by sealing regions with the cover of the housing.
15. A dispenser according to claim 14, wherein
at least one of the sealing regions surrounds the bellows radially on the outside.
16. A dispenser according to claim 14, wherein
the inlet valve has valve flap; and
the inlet valve corresponds essentially in its diameter to the diameter of the outer collar and is arranged aligned with the outer collar, a distance between a bottom and the valve flap of the inlet equals approximately one-third to one-half of the diameter of the inlet valve.
17. A dispenser for pasty compositions comprising
a housing with a piston therein, the housing and the piston defining a space for holding a pasty composition, the piston being displaceable only in a direction of emptying the housing of the pasty composition;
a pump element secured to the housing, said holding space laying between said piston and said pump element;
an actuating handle having a collar and lying on the outside of said housing, the handle being operatively connected to said pump element for actuating the pump element to be depressed in the direction of the piston, the collar extending inwardly toward the holding space; and wherein
said pump element comprises
an inlet valve and an outlet valve, the outlet valve being disposed in the actuating handle, the outlet valve comprising spring elements developed thereon and which extend through the collar into the inside of the dispenser, and a valve plate which is movable in a direction away from said holding space to form a valve opening between said plate and said handle, the spring elements urging the outlet valve into its closed position; and wherein
said spring elements are formed as spring legs which are developed directly free-standing on the valve plate and rest against an inner edge of the collar of the actuating handle to urge the valve plate inwardly toward the holding space for closing the outlet valve, the inner edge of the collar facing said holding space.

* * * * *